United States Patent [19]

Kusakawa et al.

[11] Patent Number: 4,508,492

[45] Date of Patent: Apr. 2, 1985

[54] MOTOR DRIVEN FUEL PUMP

[75] Inventors: Yukio Kusakawa; Toshiaki Nakamura, both of Anjo; Yoshifumi Ina, Okazaki; Takashi Inbe, Kariya, all of Japan

[73] Assignee: Nippondenso Co., Ltd., Kariya, Japan

[21] Appl. No.: 445,222

[22] Filed: Nov. 29, 1982

[30] Foreign Application Priority Data

Dec. 11, 1981 [JP] Japan ..... 56-200680
Jan. 12, 1982 [JP] Japan ..... 57-3956

[51] Int. Cl.[3] ..... F04B 17/00; F04D 5/00

[52] U.S. Cl. ..... 417/366; 417/423 R; 415/53 T; 415/213 T

[58] Field of Search ..... 415/213 T, 53 T; 417/366, 423 R

[56] References Cited

U.S. PATENT DOCUMENTS

| | | | |
|---|---|---|---|
| 1,619,285 | 3/1927 | Burks | 415/213 T |
| 1,768,243 | 6/1930 | Ferguson | 415/213 T X |
| 2,696,789 | 12/1954 | Fabig | 415/53 T |
| 3,259,072 | 7/1966 | Carpenter | 415/213 T |
| 3,445,693 | 5/1969 | Crawshaw et al. | 310/89 |
| 3,782,850 | 1/1974 | Egli et al. | 415/53 T |
| 3,871,797 | 3/1975 | Igarashi et al. | 415/213 T X |
| 3,973,867 | 8/1976 | Lee | 415/213 T |
| 4,181,473 | 1/1980 | Ina | 417/366 |

*Primary Examiner*—Carlton R. Croyle
*Assistant Examiner*—T. Olds
*Attorney, Agent, or Firm*—Cushman, Darby & Cushman

[57] ABSTRACT

A motor driven fuel pump adapted for use with a fuel injection system of an internal combustion engine has a pump housing and an impeller of regenerative pump type rotatably disposed in the housing and provided with circumferential rows of grooves formed in the opposite end faces of the impeller along the outer peripheral edges thereof. The housing is formed therein with suction and discharge ports and cooperates with the impeller to define a fuel pressurizing passage extending circumferentially of the impeller and surrounding the grooved outer peripheral section thereof. The fuel pressurizing passage is circumferentially interrupted by a partition wall disposed between the suction and discharge ports and extending radially inwardly into close contacting relationship to the outer peripheral section of the impeller to prevent flow of fuel from the discharge port toward the suction port. The discharge port is tangential to the fuel pressurizing passage to facilitate smooth flow of the pressurized fuel from the passage into the discharge port and reduce the amount of material required for the pump housing.

4 Claims, 6 Drawing Figures

MOTOR DRIVEN FUEL PUMP

BACKGROUND OF THE INVENTION

1. Field of the Invention

The present invention relates to a motor driven fuel pump for supplying liquid fuel from a tank to a fuel injection system of an automotive engine.

2. Description of the Prior Art

Displacement type pumps utilizing roller pumps have generally been used for the purpose specified above, as disclosed in U.S. Pat. No. 4,181,473, for example. Roller pumps, however, have difficulties that rollers are driven in sliding contact with the inner surfaces of pump chambers and that high levels of noises are produced due to pulsations of discharge pressures. This latter difficulty is not compatible with recent motor vehicles which are required to be operated as quietly as possible. In addition, motor pumps disadvantageously utilize a large number of component parts.

In order to eliminate the difficulties and disadvantage, it has been proposed to form a fuel pump by a regenerative pump (which is also called as "peripheral pump" or "Wesco pump"), as disclosed in U.S. Pat. No. 3,259,072. The pump of this type is not of the displacement type but produces a discharge pressure which is generally satisfactory to fuel injection systems of internal combustion engines. The regenerative or peripheral pump, however, has a shortcoming that the housing defining therein an impeller or pump chamber needs a relatively large amount of material such as a plastics material, as will be seen in FIG. 3 of the U.S. patent referred to. Thus, there has been a demand for a motor driven regenerative pump which is of a reduced size and provides an increased pump efficiency. Moreover, with the structure and arrangement of the regenerative pump shown in FIG. 3 of the U.S. patent referred to, the liquid fuel pressurized in the fuel pressurizing passage or "ring channel" 40 impinges upon the "sealing body" 46 at the discharge end of the "ring channel" 40, so that the dynamic pressure rises at the discharge end of the "ring channel". This disadvantageously increases the leakage of fuel through the inner surface of the "sealing body" 46 and the outer periphery of the impeller 36.

SUMMARY OF THE INVENTION

It is an object of the present invention to provide a motor driven fuel pump which requires a decreased amount of material of the pump housing, which is compact and which provides an improved pump efficiency.

The motor driven fuel pump according to the present invention includes a cylindrical motor housing made of metal, a motor armature rotatably disposed in the motor housing, a pump housing secured to an end of the motor housing and defining a pump chamber, and an impeller of regenerative pump type disposed in the pump chamber and rotatably jounalled by the pump housing. The impeller is drivingly connected to the motor armature and has an outer peripheral section which cooperates with a radially outer peripheral section of the inner surface of the pump chamber to define a fuel pressurizing passage extending in the circumferential direction of the impeller. The pump housing is formed therein with a suction port having an axis substantially parallel to the axis of the motor armature and communicated with the fuel pressurizing passage adjacent to one end thereof. The pump housing is further formed therein with a discharge port communicated with the fuel pressurizing passage at the other end thereof and extending therefrom substantially tangentially thereto. The discharge port has a cross-sectional area which increases from the upstream end toward the downstream end. The fuel pump according to the invention further includes a discharge pipe connected to the downstream end of the discharge port and having an axis substantially parallel to the axis of the motor armature. The central section of the impeller, the suction port and the downstream end of the discharge port are disposed on a substantially straight line.

A sealing body or partition wall disposed between the suction and discharge ports in close contacting relationship to the outer peripheral section of the impeller to prevent leakage of pressurized fuel from the discharge port toward the suction port may preferably be rounded at its end adjacent to the discharge port.

The pump housing may preferably have a plurality of circumferentially spaced tabs bent radially inwardly over the pump housing to secure the same to the motor housing.

Preferably, a small part of the pressurized fuel may be caused to flow from the pump housing into the motor housing to cool motor parts.

According to a preferred embodiment of the invention, the pump has an outer diameter of from 30 to 45 mm and disposed in a fuel tank of an associated motor vehicle. Each of the end faces of the impeller cooperates with an associated inner side face of the pump housing to define a gap of less than 250 microns. The opposite end faces of the impeller are formed therein with vane grooves the total number of which is from 70 to 120.

The above and other objects, features and advantages of the present invention will be made apparent by the following description with reference to the accompanying drawings.

DESCRIPTION OF A PREFERRED EMBODIMENT

Figure 1:
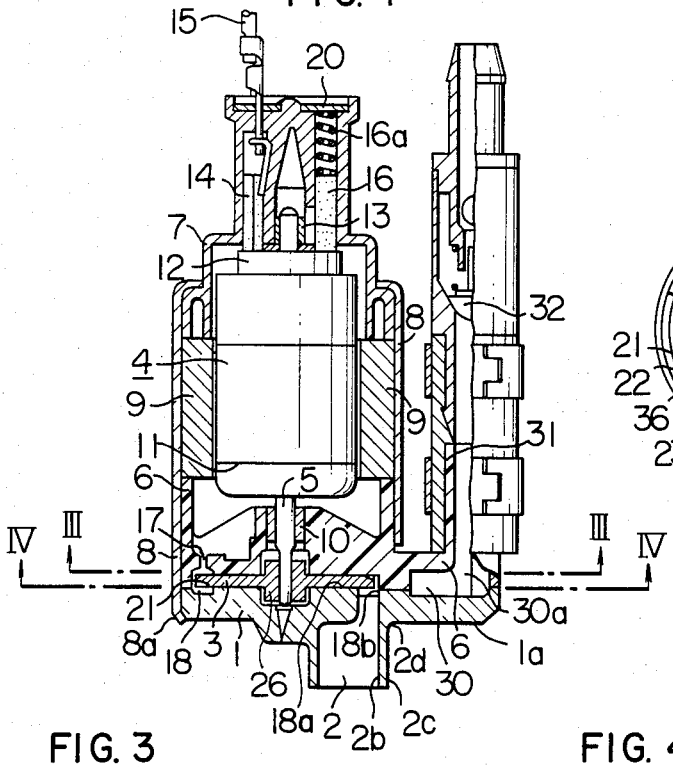
FIG. 1 is a partially axial sectional view of an embodiment of the motor driven fuel pump according to the present invention.

A motor driven fuel pump includes a pump housing which comprises a pair of pump housing members 1 and 6 which cooperate together to define a pump chamber 18 which accomodates an impeller 3 of regenerative pump type, the impeller being of so-called "closed vane type" and provided with a plurality of radial vane grooves 36 along the outer peripheral edges of the opposite end faces of the impeller. The impeller 3 is rotatably journalled by the pump housing members 1 and 6 and drivingly connected to an output shaft 5 of an electrically operated motor 4 so that the impeller is rotated in the direction indicated by an arrow D shown in FIG. 3.

The motor 4 includes a cylindrical motor housing 8 of a metal which forms a yoke of the motor 4. An armature 11 is rotatably disposed within the motor housing 8 and mounted on the output shaft 5. Magnets 9 are arranged radially outwardly and around the motor armature 11 and secured to the inner peripheral surface of the motor housing 8. The pump housing, which is formed by the pump housing members 1 and 6 as described above, is housed in the lower section of the motor housing 8 and fixedly secured thereto by circumferentially spaced tabs 8*a* which extend from the bottom end of the motor housing 8 and are bent radially inwardly over the radially outer peripheral edge of the pump housing member 1. The second pump housing 6 is formed therein with a central through-hole into which a first bearing 10 is fitted. One end of the motor output shaft 5 is journalled by the bearing 10 and extends therethrough into an axial central hole in a boss 26 of the impeller 3 for rotation therewith.

The other end of the motor housing 8 is closed by a brush housing 7 which forms a second motor housing which accomodates therein a second bearing 13 by which the other end of the motor output shaft 5 is journalled. Brushes 14 and 16 are disposed within the second motor housing in sliding engagement with a flat commutator 12 mounted on the other end of the motor output shaft 5. The brush 14 is electrically connected with a conductor 15, while the other brush 16 is also electrically connected with another conductor which is not shown.

The impeller 3 and the pump housing cooperate together to define a generally a C-shaped fuel pressurizing passage 21 which surrounds the grooved outer peripheral section of the impeller 3 and extends in the circumferential direction thereof. The first pump housing member 1 is formed therein with a suction port 2 communicated with the fuel pressurizing passage 21. The second pump housing member 6 is formed therein with a discharge port 24. The fuel pressurizing passage 21 extends from the suction port 2 to the discharge port 24. In other words, the fuel pressurizing passage 21 is circumferentially interrupted by a partition wall 27 which is integral with the second pump housing member 6 and disposed between the suction and discharge ports 2 and 24. The partition wall 27 extends radially inwardly into close contacting relationship to the outer periphery 23 of the impeller 3 to prevent leakage of pressurized fluid from the discharge port to the suction port 2 through the gap between the impeller 3 and the pump housing.

A small aperture 17 is formed in the second pump housing member 6 to communicate the pump chamber 18 with a motor chamber in the motor housing 8 so that a part of the pressurized liquid fuel flows from the pump chamber 18 through the aperture 17 into the motor chamber to cool the armature 11 and the brushes 14 and 16. This part of the liquid fuel then flows through a small aperture (not shown) in an insulation cover 20 into a fuel tank in which the fuel pump is disposed.

The discharge port 24 comprises a straight passage 30 extending between the downstream end of the fuel pressurizing passage 21 and a discharge pipe 31. The straight passage 30 is substantially tangential to the fuel pressurizing passage 21 at the downstream end thereof and has a cross-sectional area which increases from the upstream end of the straight pasage 30 toward its downstream end. In other words, the straight passage 30 is divergent to a junction 30*a* between the passage 30 and the discharge pipe 31. The pipe 31 extends substantially parallel to the axis of the motor 4 and radially outwardly spaced a distance from the outer peripheral surface of the motor housing 8. A check valve 32 is disposed within the discharge pipe 31. The junction 30*a* interconnects the straight passage 30 and the discharge pipe 31 smoothly. For this purpose, the junction 30*a*, preferably has a radius of curvature as large as possible.

In operation, when the impeller 3 is rotated by the motor output shaft 5 in the direction D, the liquid fuel is sucked from the tank through the suction port 2 into the fuel pressurizing passage 21 in which the fuel moves from the suction port towards the discharge port 24 and is progressively pressurized by the action of the radial vane grooves 36 formed in the impeller 3 until the pressurized fuel is discharged into the discharge port 24 and thus into the discharge pipe 31. It will be appreciated that, because the straight passage 30 of the discharge port 24 is tangential to the downstream end of the fuel pressurizing passage 21, the fuel flows quite smoothly into the discharge port. This feature of the invention greatly reduces the pressure loss which would otherwise be caused by a radial discharge port which deflects the direction of the flow of the pressurized fuel when it enters the radial discharge port from the circumferential fuel pressurizing passage. In addition, the feature of the invention just described greatly reduces the amount of the material 1*a* from which the pump housing is made.

When the pressurized fuel flows through the straight passage 30 of the discharge port 24, the velocity of the liquid flow is reduced due to the diverging shape of the straight passage 30 to advantageously convert the velocity energy into a pressure energy thereby decreasing the energy loss in the downstream portion of the discharge port 24.

Figure 4:
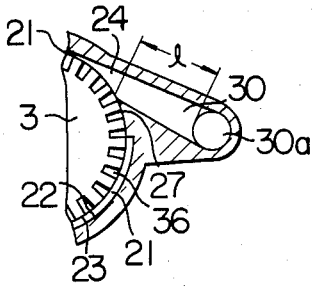
FIG. 4 is a fragmentary cross-sectional view of the pump taken along line IV—IV in FIG. 1.
Figure 5:
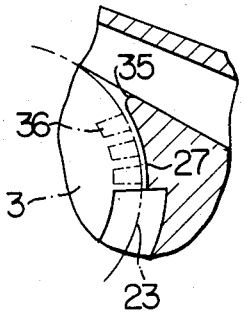
FIG. 5 is an enlarged fragmentary sectional view of the pump showing a part of FIG. 4 at an enlarged scale.

The straight passage 30 is required to be of a substantial length l (see FIG. 4). If the length l is too short, the straight passage 30 cannot have its liquid flow cross-sectional area large enough to sufficiently slow down the liquid flow through the straight passage 30, with a result that a large fluid loss is caused because, in general, the greater the velocity of fluid flow is the greater the fluid loss is. In addition, if the liquid flow cross-sectional area of the straight passage 30 is sharply increased within a short length l (namely, if the angles of the divergent portion 30 are too large), currents will be produced within the passage 30 and cause a different loss or problem. Thus, the length l of the straight portion 30 of the discharge port 24 should not be too short. The length l, however, should not be too long because the increase in the length l will result in the increase in the outer diameter of the pump.

Figure 3:
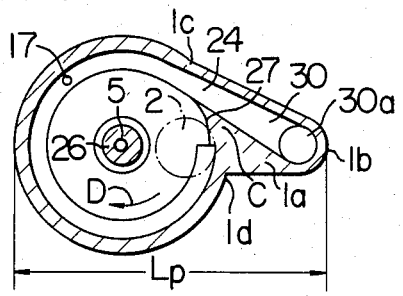
FIG. 3 is a cross-sectional view of the pump taken along line III—III in FIG. 1.

In the motor driven fuel pump according to the present invention, the tangential design of the straight passage 30 permits length l to be of a relatively large dimension as compared with a relatively small maximum cross-sectional dimension $L_p$ of the pump, as will be clearly seen in FIG. 3. This is a sharp contrast to the discharge port design of the fuel pump of the U.S. patent referred to above in which the discharge or outlet port is directed in the radial direction and, for this reason, the increase in the length of the outlet portion of the U.S. patent correspondingly increases the outer diameter of the pump housing as well as the material thereof.

The tabs 8*a* which mechanically secure the motor housing 8 to the pump housing member 1, as discussed previously, should preferably be disposed all around the outer periphery of the pump housing from the view point of the mechanical strength. In the fuel pump according to the present invention, however, no tab or tabs can be disposed in the zone of junction (the arc between the points 1*c* and 1*d* shown in FIGS. 2 and 3) between the circular major section of the pump housing member 1 and the projection 1*a* in which the straight passage 30 of the discharge port 24 is formed. This is because the discharge pipe 31 is disposed outside the pump apparatus. The fact that the pump aparatus includes a region or zone in which securing tab or tabs 8*a* cannot be disposed is inevitable in the pumps of the type to which the fuel pump according to the present invention pertains.

In the fuel pump according to the present invention, the junction (1*c*–1*d*) of the projection 1*a*, namely, the zone in which no securing tab can be disposed, is effectively utilized to form the suction port 2. This will be discussed in more detail hereunder.

In order to facilitate a smooth flow of fuel through the suction port 2 into the pump chamber, it is preferred that the rightmost side 2*d* (FIG. 1) of the inner surface of the suction port 2 should be either disposed in axial alignment with the rightmost side 18*b* of the inner surface of the pump chamber 18 or offset radially outwaredly therefrom to assure that the fuel flows through the suction port 2 vertically upwardly into the pump chamber 18. If the suction port 2 were positioned such that its axis is offset radially inwardly from the position shown in FIG. 1, the fuel is required to flow through the suction port 2 into the pump chamber 18 along a path which is upwardly rightwardly inclined relative to the vertical axis of the suction port 2 with a resultant disadvantage that the fluid loss is increased.

Despite the fact that the points 2*d* and 18*b* are axially aligned in the pump design according to the illustrated embodiment of the present invention, a cylindrical wall 2*c* of the suction port 2 interfers with the provision of a securing tab or tabs 8*a* adjacent the upper rightmost point 2*d* of the suction port 2, as will be seen in FIG. 1.

Figure 2:
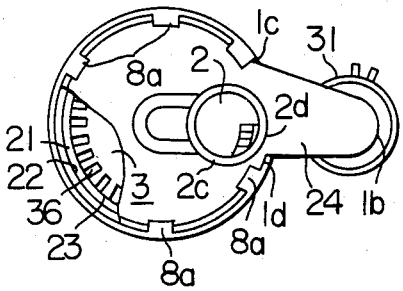
FIG. 2 is a bottom view of the pump shown in FIG. 1 with a part of the pump bottom being cut away to show an inner structure of the pump.

In the pump design according to the present invention, since the straight portion 30 of the discharge port 24 is tangential, the upper rightmost point 2*d* of the suction port 2 overlaps the junction (1*c*–1*d*) of the projection 1*a* with the circular major section of the pump housing member 1, as best seen in FIG. 2. According to the present invention, therefore, the suction port 2 can be spaced radially outwardly from the axis of the impeller 3 as large a distance as possible to minimize the fluid loss of the fuel flowing through the suction port 2 into the pump chamber 18 and, at the same time, the securing tabs 8*a* can be disposed around the pump housing over as large angles as possible to assure that no gap is produced between the motor housing 8 and the pump housing member 1 by the vibration of the pump whereby leakage of fuel and wear of the impeller 3 can be prevented and the pump can be operated without chattering.

The feature that the end or apex of the partition wall 27 adjacent to the discharge port 24 is rounded eliminates the formation of a fin which would otherwise be produced when the partition wall 27 is molded. Such a fin tends to be removed from the partition wall 27 during pump operation into the gap between the partition wall and the outer periphery of the impeller and adversely affect the rotation of the impeller.

In the illustrated embodiment of the invention, the motor 4 is adapted to be electrically energized at 12 volts and has a rated speed of 6,000 r.p.m. The motor 4 has an outer diameter of 38 mm and is provided with a total of 90 grooves 36 formed in the opposite end faces of the impeller. However, the total number of the grooves 36 may range from 70 to 120. The gap between the bottom surface of the impeller 3 and the inner surface 18*a* of the pump housing member 1 ranges from 120 to 180 microns. The pump provides rated discharge pressure of 1.1 $Kg/cm^2$ (by gauge) and discharge flow rate of 80 liters per hour which meet with the requirements by the fuel injection system for a discharge pressure of at least 0.7 $Kg/cm^2$ and for a discharge flow rate of at least 60 liters per hour.

The inventors have conducted experimental tests the results of which will be discussed hereunder.

In general, the faster the motor speed is, the higher the discharge pressure is. However, because the motors used with vehicular fuel pumps are usually D.C. motors having magnets, commutators and brushes and being adapted to be energized by batteries at 12 volts, the motor speed is limited and, if the motor is operated at a too high speed, the durability is lowered and the operation noise is increased. On the other hand, if the motor is operated at a too low speed, the durability is increased and the noise is reduced but the motor is incapable of providing a discharge pressure of the required level. It has been derived from the experimental tests that the lower limit of the motor speed is 4,000 r.p.m.

The discharge pressure of the pump is also influenced by the outer diameter of the motor and thus of the pump; and larger the diameter is, the higher the discharge pressure is. Considering the fact that the fuel pump is disposed within a fuel tank, the pump should not be too large. It has been found that the outer diameter of the pump should preferably be not greater than 45 mm and not less than 30 mm.

Figure 6:
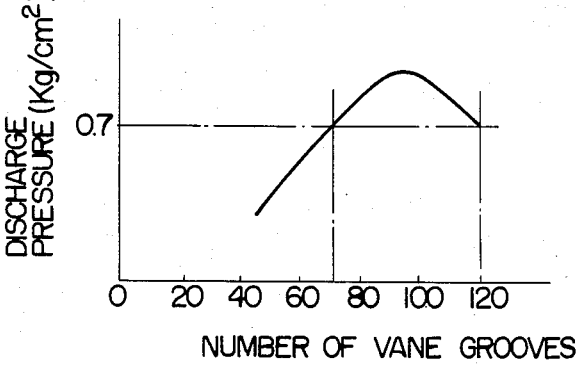
FIG. 6 graphically illustrates the operating characteristics of pumps in respect of discharge pressure relative to the number of vane grooves employed for pump impellers.

The total number of the grooves 36 formed in the opposite end faces of the impeller 3 also influences the discharge pressure. However, it has been found that the number of the grooves is not in simple or direct proportion to the discharge pressure. The inventors conducted experimental tests so as to see the mutual relationship among the minimum motor speed, motor outer diameter and number of the grooves 36 in the impeller end faces, one of the results of the tests being shown in FIG. 6 wherein the abscissa indicates the number of the vane grooves 36 in the impeller 3 while the ordinate indicates the rated discharge pressure obtained when the rated discharge flow rate was 60 liters per hour. It will be seen in FIG. 6 that the total number of the grooves 36 in the impeller end faces should be from 70 to 120 in order that the pump provides a discharge pressure of at least 0.7 $Kg/cm^2$ when the rated discharge rate is the minimum value, i.e., 60 liters per hour.

In the pump used for the tests, the gaps between the bottom surfaces of the impellers 3 and the inner surfaces of the pump housing members 1 were each 250 microns. The gap in question should preferably be as small as possible. It is, however, practically impossible to obtain a gap of less than 50 microns. On the other hand, a gap greater than 250 microns provides little merit on the producibility of the pump and allows an increased leakage of fluid from the discharge side of the pump to the suction side with a resultant reduction in the pump efficiency.

It has therefore been derived from the tests that, in order to obtain a discharge pressure of at least 0.7 $Kg/cm^2$ and a discharge flow rate of at least 60 liters per hour, the motor driven fuel pump should be operative at a speed of at least 4,000 r.p.m. and have an outer diameter of from 30 to 45 mm, a gap of less than 250 microns measured between the bottom surface of the impeller and the associated inner surface of the pump housing and a total of from 70 to 120 grooves formed in the opposite end faces of the impeller along the outer peripheral edges thereof. Motor driven fuel pumps which meet with the above requirements will satisfy the requirements by electronically controlled fuel injection systems in respect of the fuel supply pressure and rate.

As discussed above, the present invention provides a non-displacement, single stage and single impeller type of motor driven fuel pump which can be used with a fuel injection control system which has recently been used for motor vehicles, known as a "single point injection type" and calls for a fuel prressure of from 0.7 to 2.0 $Kg/cm^2$ which is an intermediate pressure level for the systems of this class.

What is claimed is:

1. A motor driven fuel pump comprising:

said pump housing being further formed therein with a discharge port communicated with said fuel pressurizing passage at the other end thereof and extending therefrom substantially tangentially thereto, said discharge port having a cross-sectional area which increases from its upstream end toward the downstream end; and a discharge pipe connected to the downstream end of said discharge port and having an axis substantially parallel to the axis of said motor armature;

said impeller having a central section;

said impeller central section, said suction port and the downstream end of said discharge port being disposed on a substantially straight line; wherein said motor housing has a plurality of circumferentially spaced tabs bent radially inwardly over said pump housing to secure the same to said motor housing.

2. A motor driven fuel pump according to claim 1, wherein said pump housing includes a partition wall disposed between said suction and discharge ports in close contacting relationship to the outer peripheral section of said impeller to prevent leakage of pressurized fuel from said discharge port toward said suction port; said partition wall being rounded at its end adjacent to said discharge port.

3. A motor driven fuel pump according to claim 1,